US008573417B1

(12) United States Patent
Anderson

(10) Patent No.: US 8,573,417 B1
(45) Date of Patent: Nov. 5, 2013

(54) MOBILE CLOTHESLINE

(75) Inventor: Jonathan Anderson, Plainfield, NJ (US)

(73) Assignee: Jonathan Anderson, Plainfield, NJ (US)

( * ) Notice: Subject to any disclaimer, the term of this patent is extended or adjusted under 35 U.S.C. 154(b) by 0 days.

(21) Appl. No.: 13/517,593

(22) Filed: Jun. 13, 2012

(51) Int. Cl.

| | |
|---|---|
| ***A47G 29/087*** | (2006.01) |
| *D06F 53/00* | (2006.01) |
| *A47B 43/00* | (2006.01) |
| *A47F 5/12* | (2006.01) |
| *A47K 1/04* | (2006.01) |
| *A47J 47/16* | (2006.01) |

(52) U.S. Cl.
USPC ..... 211/119.01; 211/119.16; 211/196; 211/168; 248/129; 248/132

(58) Field of Classification Search
USPC ..... 211/119.01, 119.02, 119.06, 119.07, 211/119.08, 119.09, 119.1, 119.12, 211/119.14–119.18, 94.03, 107, 126.6, 211/132.1, 133.1, 133.4, 190–192, 211/195–196, 85, 205–206, 110, 111, 189, 211/169–174, 165, 168; 248/128, 129, 130, 248/132, 136; 108/99, 162, 163, 115
See application file for complete search history.

(56) References Cited

U.S. PATENT DOCUMENTS

| | | | | | |
|---|---|---|---|---|---|
| 118,241 | A | * | 8/1871 | Herreman | 211/107 |
| 120,719 | A | * | 11/1871 | Gabriel | 211/107 |
| 174,166 | A | * | 2/1876 | Swett | 211/209 |
| 284,286 | A | * | 9/1883 | Downing | 211/171 |
| 414,181 | A | * | 11/1889 | Bardsley | 211/189 |
| 437,035 | A | * | 9/1890 | McGann | 211/173 |
| 437,036 | A | * | 9/1890 | McGann | 248/286.1 |
| 516,869 | A | * | 3/1894 | Melzer | 248/125.2 |
| 881,784 | A | * | 3/1908 | Fitts | 211/94.03 |
| 932,353 | A | * | 8/1909 | Teach | 211/119.16 |
| 1,021,274 | A | * | 3/1912 | Stancliff | 211/119.16 |
| 1,061,851 | A | * | 5/1913 | Krebs | 211/119.17 |
| 1,073,230 | A | * | 9/1913 | Gould | 248/333 |
| 1,075,395 | A | * | 10/1913 | Beegle | 211/196 |
| 1,107,075 | A | * | 8/1914 | Karges | 403/63 |
| 1,185,642 | A | * | 6/1916 | Emerson | 135/139 |
| 1,214,182 | A | * | 1/1917 | Kramer | 211/99 |
| 1,217,336 | A | * | 2/1917 | Niles | 211/119.17 |
| 1,220,713 | A | * | 3/1917 | Anderson | 211/119.16 |
| 1,242,867 | A | * | 10/1917 | Robinson | 211/119.16 |
| 1,280,174 | A | * | 10/1918 | Dancer | 211/45 |
| 1,373,967 | A | * | 4/1921 | Lofquist | 254/374 |
| 1,532,302 | A | * | 4/1925 | Cooper | 211/119.17 |
| 1,748,597 | A | * | 2/1930 | Collins | 211/172 |
| 1,822,907 | A | * | 9/1931 | Ruchie | 211/119.17 |
| 1,883,974 | A | * | 10/1932 | Kusterle | 108/10 |
| 1,973,521 | A | * | 9/1934 | Bullard | 211/172 |
| 2,293,251 | A | * | 8/1942 | Fords | 211/119.1 |
| 2,469,494 | A | * | 5/1949 | Bushko | 211/172 |
| 2,594,738 | A | * | 4/1952 | Curtz | 211/119.17 |

(Continued)

*Primary Examiner* — Joshua J Michener
*Assistant Examiner* — Devin Barnett

(57) ABSTRACT

A mobile clothesline provides mobility and is easy to set up and break down, making it ideal for areas with limited space, for example, while not requiring tools for assembly. The mobile clothesline offers an energy efficient alternative to using an electric or gas dryer. The mobile clothesline includes first and second wheeled bases having a receptacle for holding a retractable clothesline post. The post may include a plurality of arms that may extend outward from the post or may be folded in against the post. A retractable line may extend from the arms on one of the posts to interconnect with a receptacle on the arm on the other post.

14 Claims, 3 Drawing Sheets

(56) References Cited

U.S. PATENT DOCUMENTS

| | | | | | |
|---|---|---|---|---|---|
| 2,615,582 | A | * | 10/1952 | Moe | 211/119.15 |
| 2,638,231 | A | * | 5/1953 | Tardie et al. | 211/119.01 |
| 2,754,010 | A | * | 7/1956 | Griffith | 211/97 |
| 2,769,554 | A | * | 11/1956 | Bodine | 211/119.15 |
| 2,795,337 | A | * | 6/1957 | Hagar | 211/197 |
| 2,814,391 | A | * | 11/1957 | Gibson et al. | 211/198 |
| 2,896,792 | A | * | 7/1959 | Bodine | 211/119.15 |
| 2,899,080 | A | * | 8/1959 | Merkouris | 211/119.17 |
| 2,904,189 | A | * | 9/1959 | Eisert | 211/119.1 |
| 2,914,188 | A | * | 11/1959 | Hansen et al. | 211/119.15 |
| 2,957,669 | A | * | 10/1960 | Berlin | 248/121 |
| 2,989,267 | A | * | 6/1961 | Mehl | 242/384.7 |
| 3,018,898 | A | * | 1/1962 | Frazelle | 211/107 |
| 3,145,965 | A | * | 8/1964 | Stein | 248/408 |
| 3,215,279 | A | * | 11/1965 | Leo | 211/119.15 |
| 3,263,939 | A | * | 8/1966 | Menkin | 242/384.7 |
| 3,313,425 | A | * | 4/1967 | Injeski | 211/204 |
| 3,363,777 | A | * | 1/1968 | Cooper | 211/85.3 |
| 3,391,491 | A | * | 7/1968 | Daly | 47/46 |
| 3,477,660 | A | * | 11/1969 | Abraham | 242/379 |
| 3,509,678 | A | * | 5/1970 | Dake | 248/218.4 |
| 3,521,757 | A | * | 7/1970 | Liebscher | 211/1.3 |
| 3,584,745 | A | * | 6/1971 | Wrightson | 211/119.15 |
| 3,846,213 | A | * | 11/1974 | Thiemann | 428/9 |
| 4,094,414 | A | * | 6/1978 | Thiot et al. | 211/1.3 |
| 4,131,205 | A | * | 12/1978 | Malecki | 211/200 |
| 4,434,898 | A | * | 3/1984 | McCarthy | 211/1.3 |
| 4,460,093 | A | * | 7/1984 | Otema | 211/4 |
| 4,496,615 | A | * | 1/1985 | Huang | 428/9 |
| 4,735,326 | A | * | 4/1988 | Steiner | 211/197 |
| 4,830,202 | A | * | 5/1989 | Steiner | 211/197 |
| 5,220,740 | A | * | 6/1993 | Brault | 40/606.02 |
| 5,372,266 | A | * | 12/1994 | Fisher | 211/189 |
| 6,308,843 | B1 | * | 10/2001 | De Boer | 211/119.01 |
| 6,488,160 | B2 | * | 12/2002 | Wang | 211/195 |
| 6,702,129 | B1 | * | 3/2004 | Harris | 211/196 |
| 7,140,581 | B1 | * | 11/2006 | White | 248/129 |
| 7,484,594 | B1 | * | 2/2009 | Feliciano et al. | 182/127 |
| 8,342,544 | B1 | * | 1/2013 | Blewett et al. | 280/79.11 |
| 8,418,860 | B2 | * | 4/2013 | Rimmer et al. | 211/85.7 |
| 2003/0164348 | A1 | * | 9/2003 | Seng | 211/196 |
| 2005/0029213 | A1 | * | 2/2005 | Yong | 211/206 |
| 2006/0070249 | A1 | * | 4/2006 | Wallach et al. | 33/1 G |
| 2008/0035593 | A1 | * | 2/2008 | Roberts | 211/195 |
| 2008/0105779 | A1 | * | 5/2008 | Han | 242/386 |
| 2010/0072314 | A1 | * | 3/2010 | Sherman et al. | 242/388.91 |
| 2010/0219145 | A1 | * | 9/2010 | De Boer | 211/119.1 |
| 2012/0012548 | A1 | * | 1/2012 | Stringer | 211/119.01 |
| 2013/0062296 | A1 | * | 3/2013 | Roberts et al. | 211/119.01 |

* cited by examiner

MOBILE CLOTHESLINE

BACKGROUND OF THE INVENTION

The present invention relates to a mobile clothesline and, more particularly, to a mobile clothesline that can air dry garments indoors or outdoors in an energy efficient and cost effective manner.

Drying clothes in a clothes dryer can cause damage to the fabric of clothes and can also cause significant shrinkage to shirts, sweats, and the like. Drying clothes in a clothes dryer, be it an electric or gas, uses significant energy resources, resulting in high energy bills.

Air drying of clothes can save time money and help extend the life of a garment. Air drying allows clothes to maintain a newer look longer. Air drying is also eco-friendly, using zero energy resources.

Many clotheslines capable of air drying a full load after washing are fixed in one location. This requires a location dedicated to the installation of the clothesline. The mobile clothesline is not fixed to one location. The mobile clothesline can easily be setup anywhere and moved to follow the direction of the sun. Often, the installation of clotheslines may be forbidden by restrictive covenants in some neighborhoods, preventing users from the benefits of air drying their clothes. The mobile clothesline is ideal for restrictive communities because it's easy to setup and easily stores away when not in use.

Moreover, these conventional clotheslines, once installed, cannot be moved or used in any other location. This may be particularly inconvenient for people with smaller yards without the space to dedicate to a clothesline. Many people like to entertain in the yard, especially during the spring, summer and fall months, when an outdoor clothesline would be most used. However, when entertaining, most people do not want a permanent clothesline installed in their yard.

Most of these conventional clotheslines are installed by digging a hole and placing one or more posts in the ground, or by running a line from the house to a tree or other permanent fixture in the yard. Neither of these options is attractive to look at, especially when they cannot be removed.

As can be seen, there is a need for a clothesline that may provide ample clothes drying space and may be easily removed out of the way when not in use.

SUMMARY OF THE INVENTION

In one aspect of the present invention, a mobile clothesline comprises first and second base members; first and second base posts attached to the first and second base members; first and second telescoping posts adapted to telescope from the first and second base posts; a plurality of swing arms extendable from the first telescoping post, the swing arms movable between a first position extending away from the first telescoping post at an angle, an a second position where the swing arms rest flush with the first telescoping post; a plurality of retractable line swing arms extendable from the second telescoping post, the retractable line swing arms movable between the first position extending away from the second telescoping post at an angle, the second position where the swing arms rest flush with the first telescoping post; a line extendable from the retractable line swing arms; a ball anchor at the end of the line; and a keyhole formed in the swing arms, the keyhole adapted to receive the retain the ball anchor, causing the line to extend from the retractable line swing arms of the second telescoping post to the swings arms of the first telescoping post.

In another aspect of the present invention, a mobile clothesline comprises first and second base members having wheels disposed on one side thereof; first and second base posts attached to the first and second base members; first and second telescoping posts adapted to telescope from the first and second base posts; a telescoping post release button adapted to release the telescoping post to cause the telescoping post to retract into the base post; a plurality of swing arms extendable from the first telescoping post, the swing arms movable between a first position extending away from the first telescoping post at an angle, an a second position where the swing arms rest flush with the first telescoping post; a plurality of retractable line swing arms extendable from the second telescoping post, the retractable line swing arms movable between the first position extending away from the second telescoping post at an angle, the second position where the swing arms rest flush with the first telescoping post; a line extendable from the retractable line swing arms; a line cord retractor spool adapted to permit the line to wind thereupon when the line is not extended from the retractable line swing arms; a ball anchor at the end of the line; and a keyhole formed in the swing arms, the keyhole adapted to receive the retain the ball anchor, causing the line to extend from the retractable line swing arms of the second telescoping post to the swings arms of the first telescoping post.

These and other features, aspects and advantages of the present invention will become better understood with reference to the following drawings, description and claims.

DETAILED DESCRIPTION OF THE INVENTION

Figure 1:
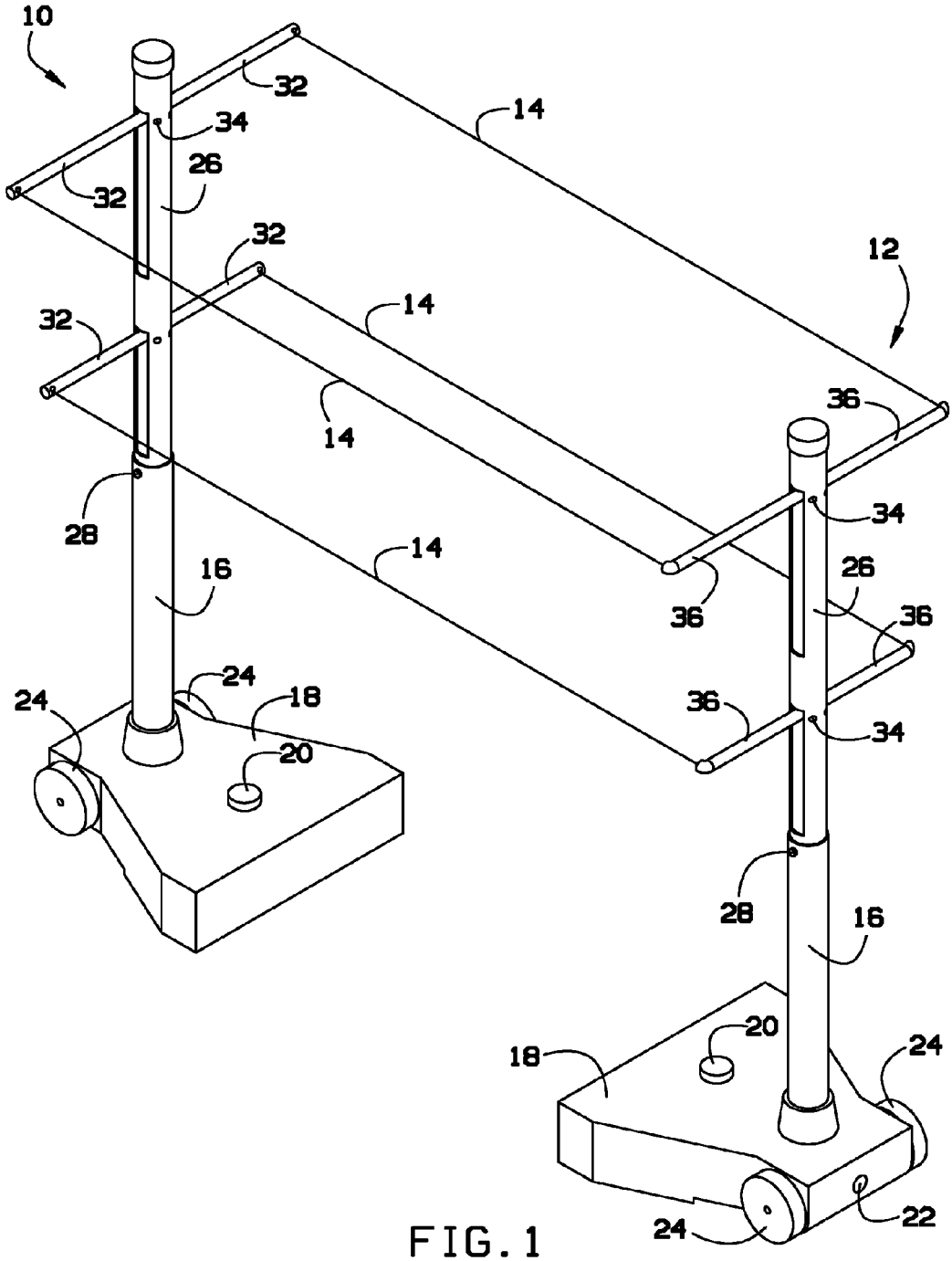
FIG. 1 is a perspective view of a mobile clothesline according to an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a mobile clothesline that provides mobility and is easy to set up and break down. The mobile clothesline is ideal for areas with limited space, for example, and does not require tools for assembly. The mobile clothesline offers an energy efficient alternative to using an electric or gas dryer. The mobile clothesline includes first and second wheeled bases having a receptacle for holding a retractable clothesline post. The post may include a plurality of arms that may extend outward from the post or may be folded in against the post. A retractable line may extend from the arms on one of the posts to interconnect with a receptacle on the arm on the other post.

Referring now to FIGS. 1 through 9, a mobile clothesline may include a non-retractable side 10 and a retractable side 12. Each side may include a base post 16 having a telescoping post 26 extending therefrom. A telescoping post release button 28 may be provided to permit a user to allow the telescoping post 26 to retract into the base post 16. In some embodiments, depressing the telescoping post release button 28 may cause a resilient pin disposed on the telescoping post 26 to move out of a hole provided in the base post 16, allowing the telescoping post 26 to move freely within the base post 16. When the user raised the telescoping post 26, the resilient pin may spring into place into the hole in the base post 16, fixing the position of the telescoping post 26 relative to the base post 16. Of course, other methods for providing a telescoping post structure are contemplated within the scope of the present invention.

In some embodiments, more than one telescoping post 26 may be provided, with subsequent telescoping posts 26 extending from the post therebelow. A telescoping post release button 28 may be provided for each telescoping post 26 to allow it to either be locked in place or telescope inside the post below.

In some embodiments, the telescoping post 26 may be locked in a first, shortened position, where only an upper set of swing arms 32 are available to the user to open. A second, fully extended position may also lock the telescoping post 26 with the base post 16, wherein both an upper and lower sets of swing arms 32 may be extended. In this embodiment, a user may partially extend the telescoping post 26, extend the line 14, and hand clothes. Once this line is filled, the user may further extend the telescoping post 26 to lock it into place fully extending, permitting the lower set of swing arms 32 to be used for additional clothes. This design may be suitable for shorter users that may have difficulty reaching an upper set of swing arms 32.

Figure 5:
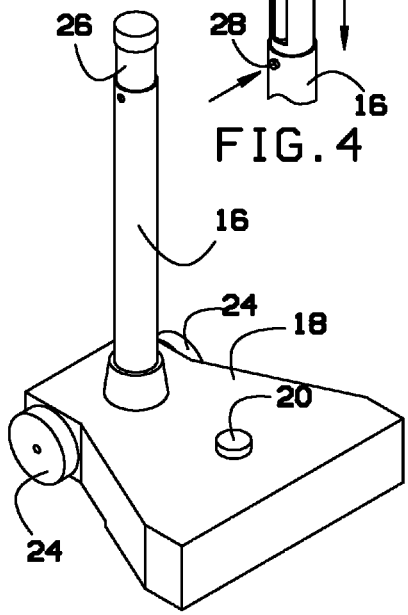
FIG. 5 is a perspective view of a mobile clothesline side in a retracted position.

The base post 16 may attach to a base member 18. The base member 18 may be a fillable base member adapted to be filled with a material, such as water, sand, or the like. The base member 16 may include a drain port 22 to help in removing the filled material, if desired. The base post 16 may attach along one side of the base member 18, typically a side away from the side from which a line 14 will extend. This configuration provides support for the clothesline, even when a heavy load of clothes are disposed on the line 14. Typically, the base post 16 will attach on the side defined by an axis (not shown) connecting the wheels 24 of the base member 18. This design provides that, when in a retracted position as shown in FIG. 5, the base post 16 may be used as a handle to tip and roll the base member 18 to or from a storage location.

Figure 4:
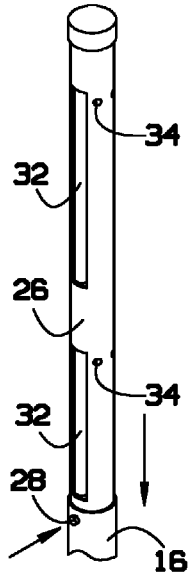
FIG. 4 is a perspective view of a telescoping post with swing arms in a retracted position.

The telescoping posts 26 may include a plurality of swing arms 32, 36 (swing arms 32 are disposed on the non-retractable side 10 and swing arms 36 are disposed on the retractable side 12 of the mobile clothesline). The swing arms 32 may be disposed in a closed position, as shown in FIG. 4, where the swing arms 32 fit flush against the telescoping posts 26, allowing the telescoping posts 26 to fit into the base post 16.

Figure 2:
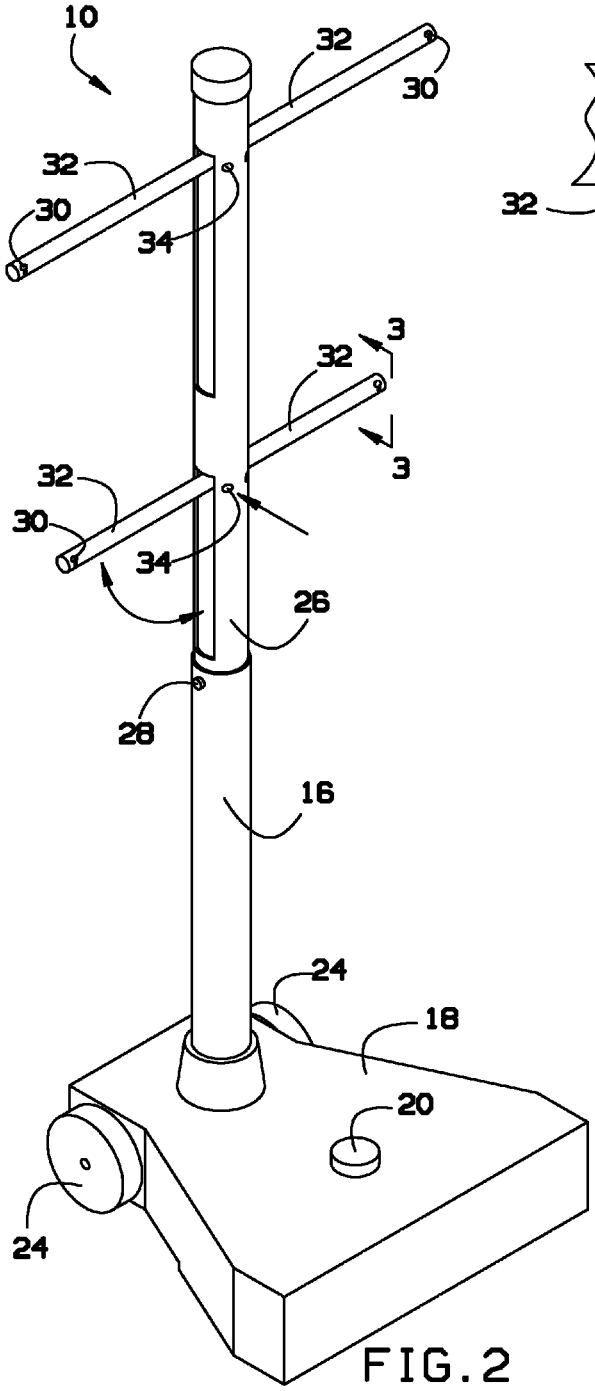
FIG. 2 is a perspective view of a mobile clothesline non-retractable side of the mobile clothesline of FIG. 1.
Figure 3:
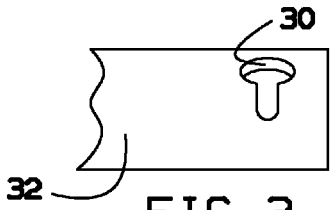
FIG. 3 is a detailed view of a clothesline keyhole taken along line 3-3 of FIG. 2.

The swing arms 32 may be opened to an open position, as shown in FIG. 2, where the swing arms 32 extend outward from the telescoping post 26 at an angle of about 90 degrees. A swing arm release button 34 may keep the swing arms 32 in a desired position, such as open or closed, and, pressing the swing arm release button 34 may permit the swing arm 32 to move out of the locked open or closed position.

In some embodiments, the swing arms 32, 36 may be disposed to extend from opposite sides of the telescoping post 26. When two adjacent swing arms (also referred to as a set of swing arms) are open, as shown in FIG. 2, they may align about 180 degrees with respect to each other.

In some embodiments, two sets of swing arms 32, 36 may be disposed on the telescoping post 26. In this embodiment, an upper set of swing arms 32, 36 may be longer or shorter than a lower set of swing arms 32, 36, such that clothe hanging on the line 14 spanned between upper sets of swing arms 32, 36 does not interfere with clothes disposed on the line 14 spanned between lower sets of swing arms 32, 36.

In some embodiments, the length of the swings arms 32, 36 may be the same size, but one set of swing arms 32, 36, such as the upper set of swing arms, may lock in place at an angle less than 90 degrees relative to the telescoping post 26. Therefore, this angled set of swing arms may be a shorter distance away from the telescoping post 26 than the set of swing arms at 90 degrees, thus providing non-interfering clothes hanging with the same length of swing arms 32, 36. When the upper set is disposed at an angle less than 90 degrees, this also lowers the upper set of swing arms, potentially making it easier for the user to reach.

In the non-retractable side 10 of the mobile clothesline, at each end of the swing arms 32, a clothesline keyhole 30 may be disposed. The clothesline 14 may have a ball anchor 40 on its end. The clothesline 14 can be extended from the swing arms 36 on the retractable side 10 of the mobile clothesline and the ball anchor 40 may lock into the keyhole 30. From about 6 to about 20 feet, typically about 10 feet, of line 14 may be permitted to extend from each of the swing arms 36 on the retractable side 12 of the mobile clothesline.

Figure 9:
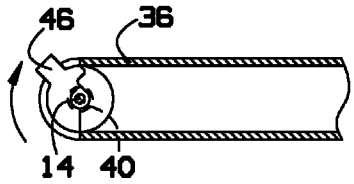
FIG. 9 is a detailed cross-sectional view, similar to FIG. 8, except that the line cord stop is in a closed position.
Figure 8:
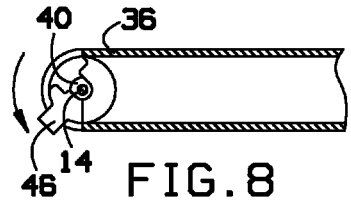
FIG. 8 is a detailed cross-sectional view taken along line 8-8 of FIG. 6, with a cord line stop in an open position.
Figure 7:
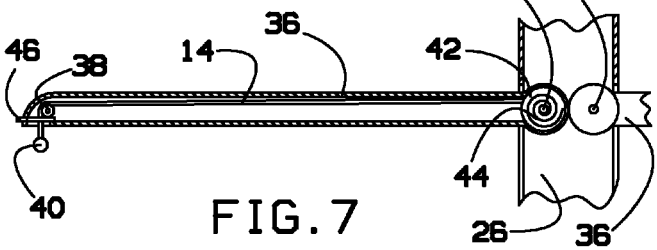
FIG. 7 is a detailed cross-sectional view taken along line 7-7 of FIG. 6.
Figure 6:
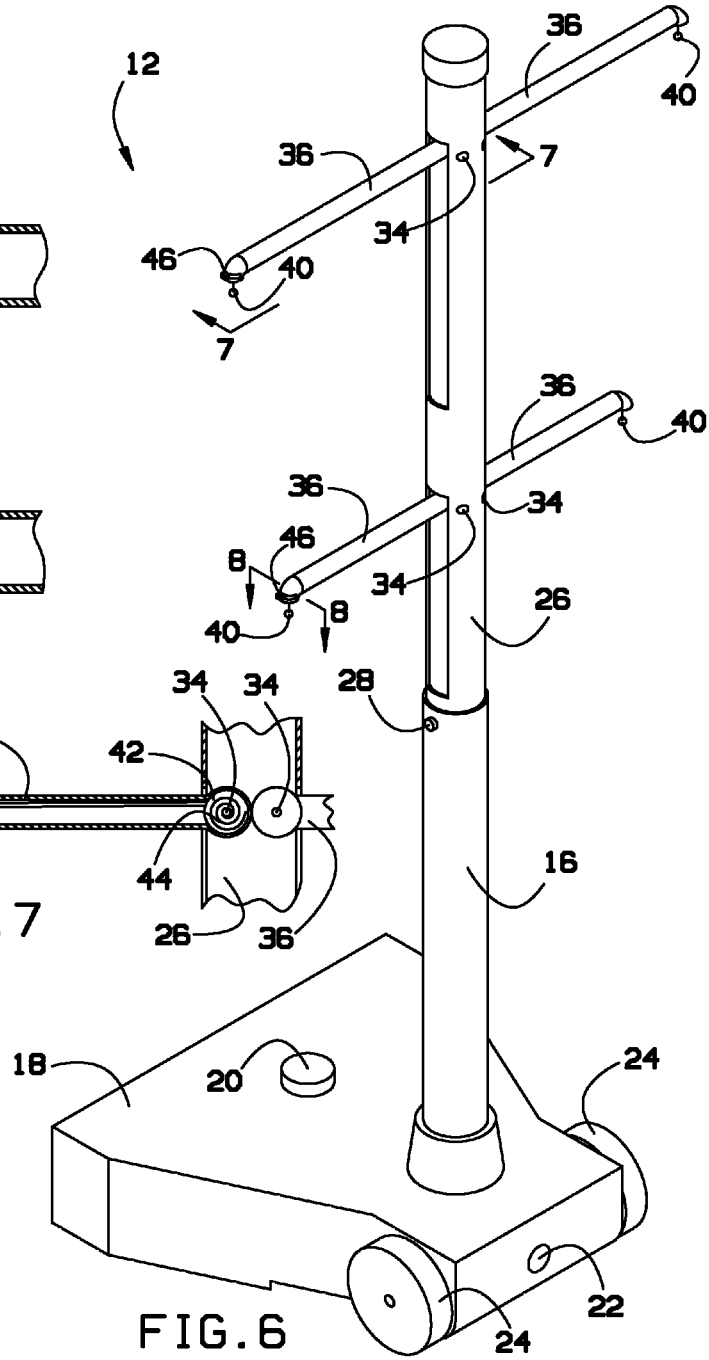
FIG. 6 is a perspective view of a retractable line side of the mobile clothesline of FIG. 1.

A line cord stop 46 may be provided where the line 14 exits the swing arm 36. The line cord stop 46 may be movable between an open position, as shown in FIG. 8, where the line 14 is free to move in and out of the swing arm 36, and an closed position, as shown in FIG. 9, where the line 14 is locked in position and cannot be extended from or retracted into the swing arm 36. A line cord guide wheel 38 may guide the line 14 out of the swing arm 36.

A retractor spool 42 may be provided to retract the line 14 into the swing arm 36. When the line cord stop 46 is closed (FIG. 9), the retractor spool 42 cannot pull the line 14 into the swing arm 36. However, when the line cord stop 46 is open (FIG. 8), the retractor spool 42 can pull the line 14 back into the swing arm. The retractor spool 42 may be positioned in the telescoping post 26. A line cord retractor coil spring 44 may be used to cause the retractor spool 42 to wind the line 14 thereabout.

The mobile clothesline of the present invention can be set up quickly and easily. A user can roll each of the non-retractable side 10 and the retractable side 12 into position where they would like a line 14 to span therebetween. The telescoping post 26 may be raised from the base post 14 and the swing arms 32, 36 may be extended. The line 14 may be extended from the swing arms 36 such that the line cord ball anchors 40 are locked into place in the keyholes 30 on the swing arms 32. The line cord stop 46 may be closed to prevent excess line 14 from extending from the swing arm 36 when clothes are hung on the line 14. When the user is done with the mobile clothesline, they can simply reverse the steps and wheel the clothesline to a storage location. Typically, the material used in the base members 18 (such as sand or water) may not be removed between uses, but a user may, for example, drain water from the base members 18 to make the mobile clothesline easier to move.

It should be understood, of course, that the foregoing relates to exemplary embodiments of the invention and that modifications may be made without departing from the spirit and scope of the invention as set forth in the following claims.

What is claimed is:

1. A mobile clothesline comprising:

first and second base members;

first and second base posts attached to the first and second base members;

first and second telescoping posts adapted to telescope from the first and second base posts; between a fully collapsed position and a fully extended position;

a plurality of swing arms extendable from the first telescoping post, the swing arms movable between a first position extending away from the first telescoping post at an angle, an a second position where the swing arms rest flush with the first telescoping post;

a plurality of retractable line swing arms extendable from the second telescoping post, the retractable line swing arms movable between the first position extending away from the second telescoping post at an angle, the second position where the swing arms rest flush with the first telescoping post;

at least one line extendable from the retractable line swing arms; a ball anchor at the end of each line; and at least one keyhole formed in the swing arms, each keyhole adapted to receive and retain a corresponding ball anchor, causing each line to extend from the retractable line swing arms of the second telescoping post to the corresponding swings arms of the first telescoping post;

at least one line cord retractor spool located within the retractable line swing arms, wherein each line cord is adapted to permit each line to wind thereupon when the lines are not extended from the retractable line swing arms;

wherein the plurality of swing arms and the plurality of retractable line swing arms fit within the corresponding first and second base posts when the first and second telescoping posts are in the fully collapsed position.

2. The mobile clothesline of claim 1, further comprising a fill port in each of the first and second base members, each fill port permitting a user to place a material inside each of the base members.

3. The mobile clothesline of claim 2, further comprising a drain port in each of the first and second base members.

4. The mobile clothesline of claim 1, further comprising a telescoping post release button on each of the first and second base posts, wherein each release button is adapted to release a corresponding telescoping post to cause the corresponding telescoping post to retract into a corresponding base post.

5. The mobile clothesline of claim 1, further comprising swing arm release buttons on each of the first and second telescoping posts, wherein each release button is adapted to permit corresponding swing arms to be released from the first position and moved to the second position.

6. The mobile clothesline of claim 1, further comprising at least one line cord retractor coil spring adapted to resiliently allow the at least one line to be retracted from the at least one retractor spool and to wind each line about each retractor spool.

7. The mobile clothesline of claim 1, further comprising at least one line cord stop adapted to prevent the at least one line to be retracted into or pulled from corresponding retractable line swing arms.

8. The mobile clothesline of claim 7, wherein the at least one line cord stop is disposed on at least one of the retractable line swing arms.

9. The mobile clothesline of claim 1, further comprising at least one line cord guide wheel adapted to guide the at least one line out of corresponding retractable line swing arms.

10. The mobile clothesline of claim 1, further comprising wheels disposed on each base member.

11. A mobile clothesline comprising:

first and second base members having wheels disposed on one side thereof; first and second base posts attached to the first and second base members; first and second telescoping posts adapted to telescope from the first and second base posts;

a telescoping post release button adapted to release the telescoping post to cause the telescoping post to retract into the base post;

a plurality of swing arms extendable from the first telescoping post, the swing arms movable between a first position extending away from the first telescoping post at an angle, an a second position where the swing arms rest flush with the first telescoping post;

a plurality of retractable line swing arms extendable from the second telescoping post, the retractable line swing arms movable between the first position extending away from the second telescoping post at an angle, the second position where the swing arms rest flush with the first telescoping post;

at least one line extendable from the retractable line swing arms;

at least one line cord retractor spool located within the retractable line swing arms, wherein each line cord is adapted to permit each line to wind thereupon when the lines are not extended from the retractable line swing arms;

a ball anchor at each end of the line; and at least one keyhole formed in the swing arms, each keyhole adapted to receive and retain a corresponding ball anchor, causing each line to extend from the retractable line swing arms of the second telescoping post to the corresponding swings arms of the first telescoping post.

12. The mobile clothesline of claim 11, further comprising at least one line cord retractor coil spring adapted to resiliently allow the at least one line to be retracted from the at least one retractor spool and to wind each line about each retractor spool.

13. The mobile clothesline of claim 11, further comprising at least one line cord stop adapted to prevent the at least one line to be retracted into or pulled from corresponding retractable line swing arms.

14. The mobile clothesline of claim 11, further comprising a fill port in each of the first and second base members, each fill port permitting a user to place a material inside each of the base members.

* * * * *